US005150815A

United States Patent [19]

Saklad

[11] Patent Number: 5,150,815

[45] Date of Patent: Sep. 29, 1992

[54] DRINK CONTAINER

[75] Inventor: Betty E. Saklad, Tarzana, Calif.

[73] Assignee: Selandia Designs, Santa Clarita, Calif.

[21] Appl. No.: 782,806

[22] Filed: Oct. 25, 1991

[51] Int. Cl.[5] ..... B65D 47/12

[52] U.S. Cl. ..... 220/708; 220/428; 215/1 A; 215/229

[58] Field of Search ..... 215/1 A, 229; 220/426, 220/428, 705, 708, 709

[56] References Cited

U.S. PATENT DOCUMENTS 2,622,415 12/1952 Landers et al. ..... 220/428 X
4,684,032 8/1987 Tsay ..... 220/708 X
4,726,479 2/1988 Tsai ..... 215/229
4,852,762 8/1989 Chou-Sheng ..... 215/229 X
4,941,590 7/1990 Pantaleo et al. ..... 220/428

*Primary Examiner*—Stephen Marcus
*Assistant Examiner*—Nova Stucker
*Attorney, Agent, or Firm*—George J. Netter

[57] ABSTRACT

A drink container (10) has spaced apart transparent shells (20,24) with the intervening space (34) containing a liquid and floatable and sinkable objects (36). A cap (14) and cover (16) on the container open top are rotatable between a drinking position where a sipping straw (18) extends upwardly for use and a non-drinking position where the straw is moved within the cover (16) and pinched off to prevent leakage.

6 Claims, 2 Drawing Sheets

DRINK CONTAINER

BACKGROUND OF THE INVENTION

1. Field of the Invention

The present invention relates generally to a drink container with attached sipping straw means, and, more particularly, to such a container having transparent heat insulative side walls with mobile decorative means therein.

SUMMARY OF THE INVENTION

In accordance with the practice of the present invention there is provided a drink container constructed for handheld use and which includes a generally cylindrical drink receiving portion having a closed bottom and an open top. The drink receiving portion is constructed of two transparent walls maintained in a spaced apart relation throughout except for a supporting pin in the bottom portion and a common upper edge. The intervening space between the two side walls include a quantity of a fluid (e.g., water) within which a plurality of decorative objects are located, some of the objects may float and others sink. The objects are of such a size relative to the space between the container walls as to enable them to move up and down and around the glass in the event it is moved or turned upside down.

A removable cap includes straw means which are affixed to the top of the cap and have a first part that extends downwardly into the drink receiving container part and a second upwardly extending part for the user. A snap on dome-like cover is received on the top part of the cap and has a curved opening through which the sipping straw means upper end can extend. The cap is rotatable through a limited angular extent from a first position allowing the sipping straw means to extend vertically upward, to a second position where the cover contacts the straw means second part bending it generally at 90 degrees to the container axis and holds it hidden within the dome-like cover. The outer and/or inner surface of the outer drink receiving portion side wall be configured into any desirable design or decoration.

DESCRIPTION OF A PREFERRED EMBODIMENT

Figure 1:
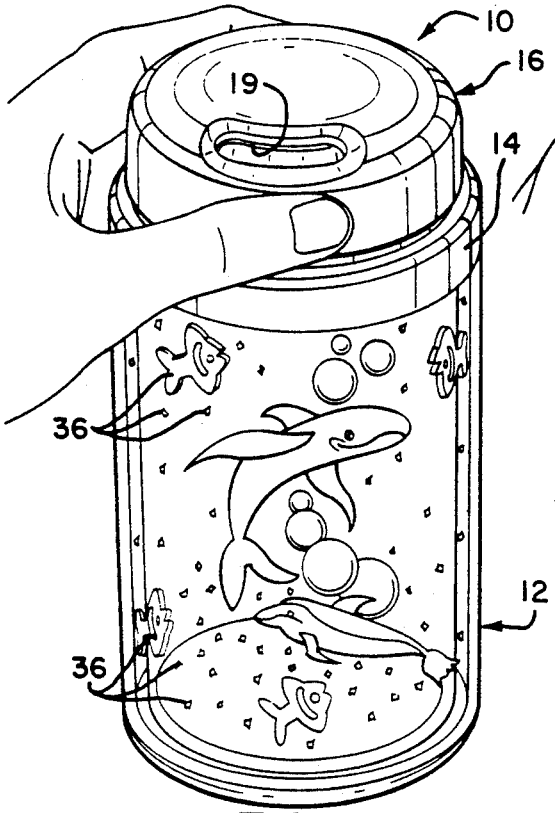
FIG. 1 shows a perspective view of the drink container of the present invention shown in its closed or non-drinking mode.
Figure 2:
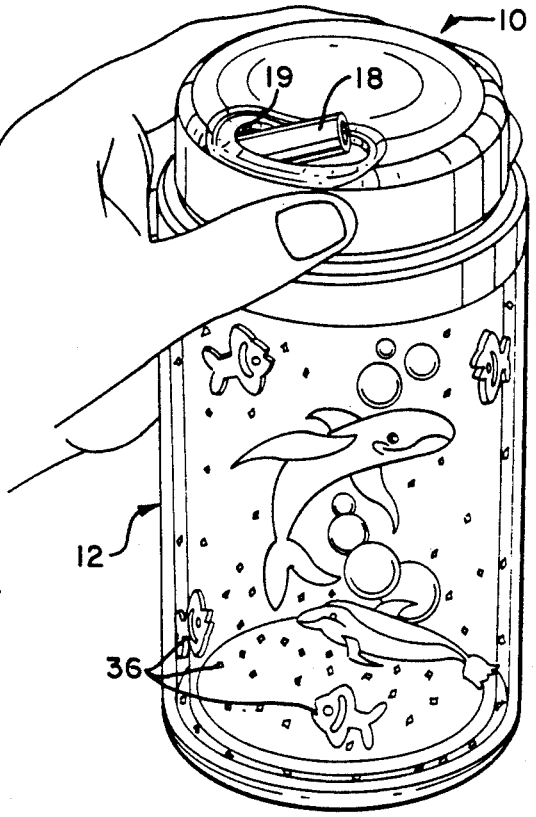
FIG. 2 shows the container in partially adjusted position for use.
Figure 3:
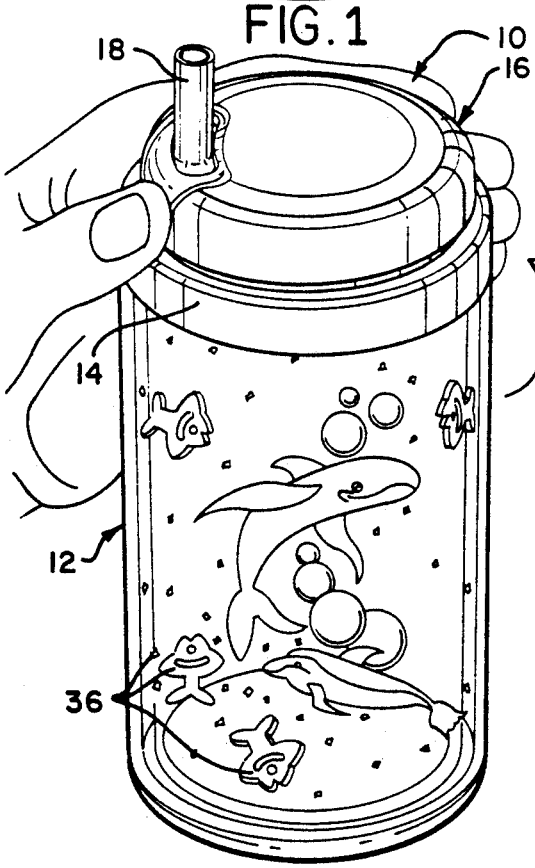
FIG. 3 shows the container in the drinking mode with the straw means extending upwardly for use.
Figure 4:
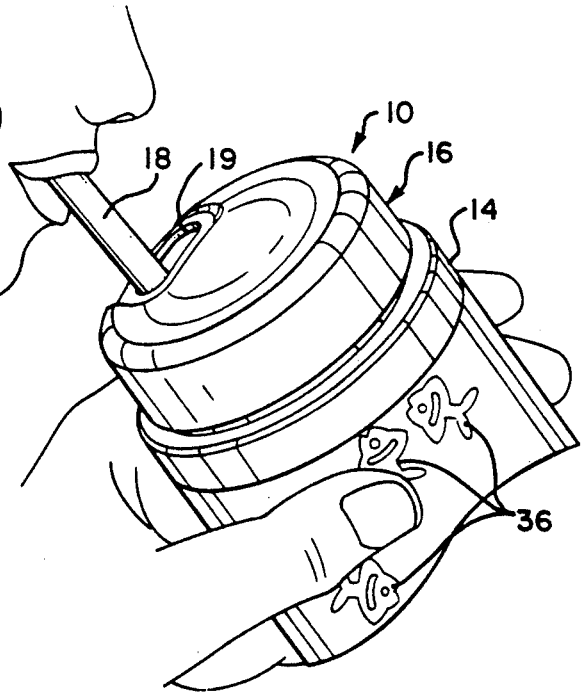
FIG. 4 shows the container in use.

Turning now to the drawings and particularly FIGS. 1 through 4, the drink container of the present invention is enumerated generally as 10 and includes a generally cylindrical liquid holder 12 with an open top onto which is threadedly received, a cap 14, and a generally dome-like cover 16 positioned on the cap 14 is rotatable from a non-drinking position (FIG. 1) to a drinking mode where a flexible sipping straw means 18 extends upwardly for use in a conventional manner (FIGS. 3 and 4). More particularly, the cover 16 has a curved slot or opening 19 in its top wall which upon rotation of the cover to a specific position allows the sipping means or sipping straw means 18 to extend therethrough and then, upon rotation back to a further limit position, completely covers the straw means and clamps it off to prevent leakage (FIG. 1).

Figure 5:
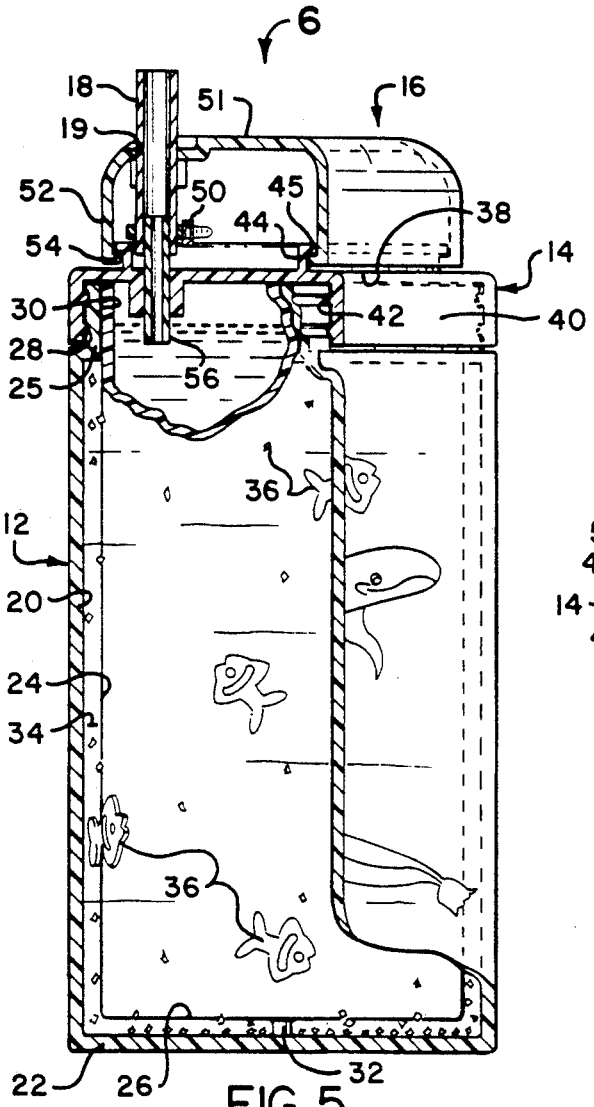
FIG. 5 is a side elevational, partially sectional view of the drink container of this invention.
Figure 7:
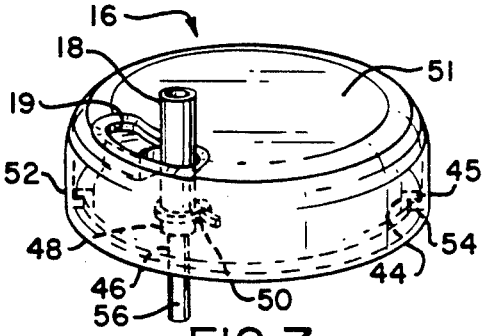
FIG. 7 is a side elevational, partially sectional view of the dome-like cover.

As can be seen best in FIG. 5, the liquid holder 12 has an outer cylindrical shell 20 with a unitary cylindrical bottom 22 and an inner cylindrical shell 24 with unitary circular bottom 26 of similar geometry to the outer shell 20 and bottom 22 but of slightly smaller dimensions, both shells 20 and 24 having open tops. The upper and open end of the shell 20 has on its uppermost edge portion 25 a set of outwardly directed threads for a use to be described. The inner surface of the threaded portion 28 is formed into a smooth cylindrical band which is spaced inwardly a uniform extent from the inner surface of the shell 20. The outer diameter of the upper end of the inner shell 24 is such that it snugly fits against the inner surface 30 and the two abutting surfaces are sealed to one another in a suitable manner during assembly of the container with a spacer 32 being centrally positioned between the two circular ends of the shells. Prior to assembly of the shells to one another to form the drink or liquid holder 12, the space 34 between the two shells is substantially filled with a liquid (e.g., water) and decorative objects 36, both floatable and sinkable, the latter being of sufficient size as to be able to freely move about the space between the shells.

It is preferable that the shells 20 and 24 and associated cylindrical bottoms 22 and 26 be constructed of a clear transparent material such as acrylic, or other material which can withstand relatively high temperature changes and has good resistance to damage from shocks. It is also contemplated that either or both the outer and inner surface of the shell 20 and circular bottom 22 may be provided with a design or decoration.

The cap 14 has a generally cylindrical top 38 of a diameter substantially equal to the outer diameter of the sidewall shell 20. A cylindrical sidewall 40 extends downwardly away from the cap top 38 and includes internal threads 42 for matching receipt on the threaded upper end portion 28 of the shell 20. The upper surface of the cap 14 has an upstanding cylindrical ridge wall 44, the upper edge of which wall has an outwardly extending flange 45 for a purpose to be described. Inwardly of the ridge wall 44 there is provided a tube 46 extending completely through the cap top 38 having portions extending both above and below the cap. The tube 46 has an outer diameter substantially identical to the inner diameter of a portion 48 of the sipping straw means 18 secured to the upper end of the tube by a locking strap 50. The sipping portion 48 only extends upwardly several inches in a manner and for a purpose to be described.

Figure 8:
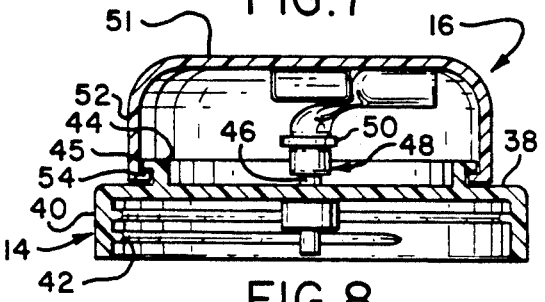
FIG. 8 is a side elevational, sectional view of the dome-like cover shown in non-drinking mode on the cap.
Figure 6:
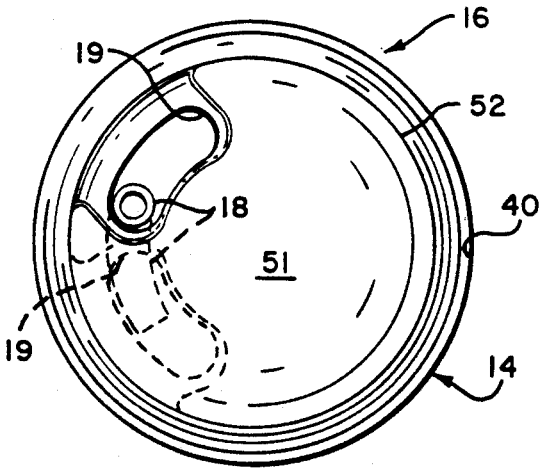
FIG. 6 is a top plan view taken along the line 6—6 of FIG. 5.
Figure 9:
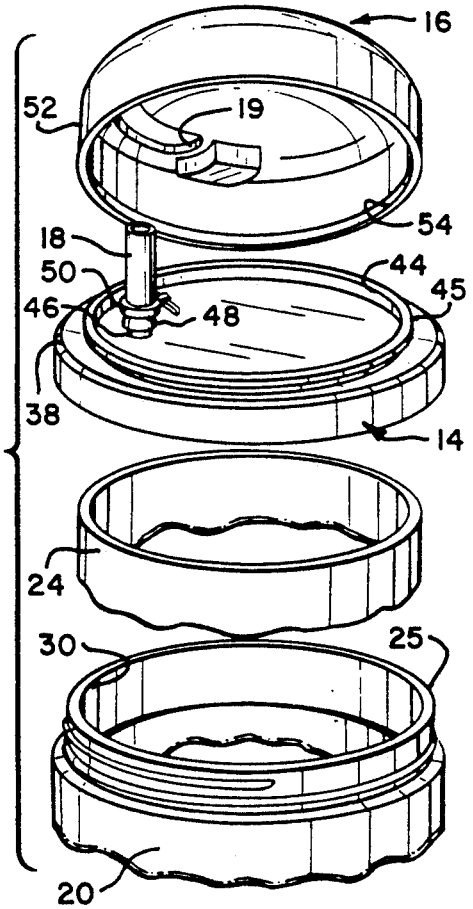
FIG. 9 is an exploded view of the various parts of this invention.

The dome-like cover 16 is generally cylindrical a the top wall 51 and has a continuous cylindrical side wall 52, the lower or open edge of the side wall 52 extending radially inward a slight amount forming a flange 54. The cover 16 is preferably constructed of a rigid yet somewhat flexible synthetic plastic and is of such dimensions as to enable snapping receipt of the open lower surface flange 54 onto the ridge wall 44. The curved slot or opening 19 in the top wall of the cover is positioned so that when aligned with the straw means portion 48 it will extend outwardly from the top. On the other hand, as is shown by comparison of FIGS. 5 and 8, on rotation of the cap 16 so that the opening 19 is not aligned with the straw means portion 48, the cap top and side walls will act to bend the straw sideways causing it to be temporarily pinched off by an internal member and thus prevent leakage when not in use. It is also necessary in use of the device to connect a further straw means portion 56 to the lower end of the tube 46 which extends downwardly into the interior of the holder 12 and contacts the liquid contained therein.

In use, with the cap 14 and unitary cover 16 removed from the holder 12, the holder is provided with the desired amount of drink. The cap is then threaded onto the holder top with the further straw means portion 56 having its lower end located within the drink. When it is desired to drink, this merely requires rotation of the cap to the position where the first sipping straw means portion 48 extends upwardly through the opening 19 (FIG. 4).

Although the invention has been described in connection with a preferred embodiment, it is to be understood that those skilled in the appertaining art may suggest modifications that come within the spirit of the invention as described and the ambit of the appended claims.

What is claimed is:

1. A handheld drink container, comprising:

an open-top, double-walled drink liquid holder including a space sealed between the walls;

a quantity of a liquid received within the holder sealed space;

at least one object received within the holder sealed space and liquid contained therein, said object being movable within said space and liquid upon movement of the container;

a cap removably secured to the holder open top;

a tube extending through an opening in the cap having a first portion extending into the drink liquid holder and a second portion extending generally upwardly and outwardly of the holder;

a sipping straw secured to the tube second portion and extending generally upwardly; and a cover rotatably secured over the cap and including an upwardly facing opening therein which can be aligned with the sipping straw allowing it to extend upwardly therethrough on rotatable adjustment of the cover to a given angular position, and on the cover being rotated to other positions bending the sipping straw to a condition where liquid cannot leak out.

2. A handheld drink container as in claim 1, in which there are provided a plurality of objects, at least one of which floats.

3. A handheld drink container as in claim 1, in which the holder includes two walls maintained in separated relation by a spacer.

4. A handheld drink container as in claim 1, in which the cover opening is elongated and curved.

5. A handheld drink container as in claim 1, in which the outer top surface of the cap includes an upstanding ridge wall with flange and the cover includes an edge flange which snaps onto the cap flange.

6. A handheld drink container as in claim 1, the in which cap and cover are constructed of a rigid somewhat flexible synthetic plastic.

* * * * *